United States Patent [19]

Bernabe, Jr.

[11] Patent Number: 5,060,427

[45] Date of Patent: Oct. 29, 1991

[54] EXTENSION AND RETRACTION SYSTEM FOR FOUR SECTION TELESCOPIC BOOM HAVING SIMULTANEOUS AND EQUAL EXTENSION AND RETRACTION OF THE TELESCOPIC SECTIONS

[75] Inventor: Vincent Bernabe, Jr., Newville, Pa.

[73] Assignee: Kidde Industries, Inc., Iselin, N.J.

[21] Appl. No.: 473,438

[22] Filed: Feb. 1, 1990

[51] Int. Cl.[5] ..... E04H 12/34

[52] U.S. Cl. ..... 52/118; 52/121; 182/141; 212/269

[58] Field of Search ..... 52/118, 120, 121; 212/267, 268, 269; 182/141

[56] References Cited

U.S. PATENT DOCUMENTS

| | | | |
|---|---|---|---|
| 2,632,530 | 3/1953 | Wagner | 52/118 X |
| 3,721,054 | 3/1973 | Hornagold | 52/118 X |
| 3,845,596 | 11/1974 | Veenstra | 52/118 |
| 4,004,695 | 1/1977 | Hockensmith et al. | 52/118 X |
| 4,217,987 | 7/1980 | Gatto et al. | 52/118 X |
| 4,327,533 | 5/1982 | Sterner | 52/118 X |
| 4,506,480 | 3/1985 | Murrill et al. | 52/121 |
| 4,514,939 | 5/1985 | Rathe et al. | 52/118 |
| 4,575,976 | 3/1986 | McDermott et al. | 52/118 |
| 4,635,805 | 1/1987 | Mentzer | 52/118 X |
| 4,690,290 | 9/1987 | Gustafsson | 52/118 X |
| 4,789,120 | 12/1988 | Spidel | 52/118 X |

*Primary Examiner*—Richard E. Chilcot, Jr.
*Assistant Examiner*—Linda J. Watson
*Attorney, Agent, or Firm*—Brady, O'Boyle & Gates

[57] ABSTRACT

An extension and retraction system for a four section telescopic boom having simultaneous and equal extension and retraction of the telescopic sections, wherein a pair of hydraulic cylinders are mounted exteriorly of the boom for extending and retracting the inner mid section relative to the base section; a pair of extension chains or cables are connected between the base section and the outer mid section, and between the fly section and the inner mid section; and a pair of retraction cables are connected between the base section and the outer mid section, and between the fly section and the inner mid section. The extension and retraction chains and cables are positioned within the boom sections to thereby be protected from damage.

15 Claims, 5 Drawing Sheets

EXTENSION AND RETRACTION SYSTEM FOR FOUR SECTION TELESCOPIC BOOM HAVING SIMULTANEOUS AND EQUAL EXTENSION AND RETRACTION OF THE TELESCOPIC SECTIONS

BACKGROUND OF THE INVENTION

Telescopic booms having extension and retraction systems employing hydraulic cylinder and cables have been proposed. For instance, in U.S. Pat. No. 4,133,411, dated Jan. 9, 1979, an extension and retraction mechanism for a three section boom is disclosed utilizing an internally disposed hydraulic cylinder connected between a stationary base boom section and an intermediate telescopic boom section with a cable connection located interiorly of the boom and having opposite ends anchored to opposite ends of the base section with the cable reeved around sheaves on the movable end of the hydraulic cylinder and a base end of the intermediate boom section with a cable attachment to the base end of a fly section of the boom, whereby the fly section is the most extensible boom section.

U.S. Pat. No. 4,575,976, dated Mar. 18, 1976, discloses an extension and retraction system for a four section boom employing hydraulic cylinders and cables for extending and retracting the boom sections. A pair of hydraulic cylinders are serially connected between the proximate end of the base section, the distal end of the base section, and the distal end of the inner mid section. While the retraction cables are located within the base, inner mid, and outer mid sections, the extension cables are located exteriorly of the respective sections, thus being exposed to the elements and unprotected from damage or abrasion during operation.

SUMMARY OF THE INVENTION

After considerable research and experimentation, the extension and retraction system of the present invention has been devised for a four section telescopic boom, wherein the extension and retraction cables are located interiorly of the boom sections, whereby the cables are protected from damage. The cylinder of a hydraulic cylinder assembly is mounted on and extends the length of the stationary base section of the boom and has the distal end of its piston rod connected to the distal end of the inner mid section of the boom. By the construction and arrangement of the hydraulic cylinder assembly, and the extension and retraction cables, actuation of the hydraulic cylinder results in the simultaneous and equal extension and retraction of the telescopic sections.

DESCRIPTION OF THE PREFERRED EMBODIMENT

Figure 1:
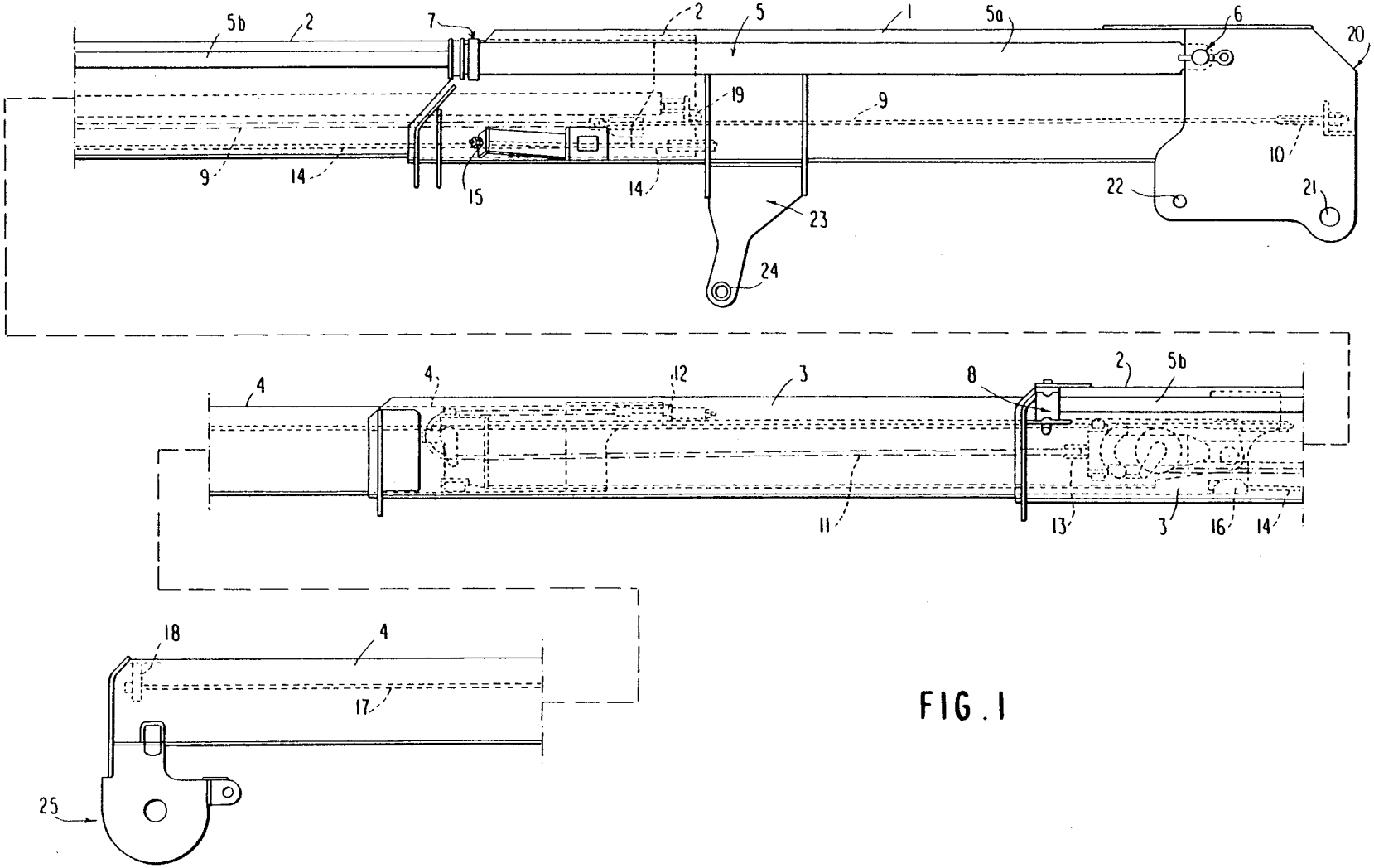
FIG. 1 is an exploded side elevational view of the four section boom of the present invention illustrating the relative positions of the boom sections when in the fully extended position.
Figure 5:
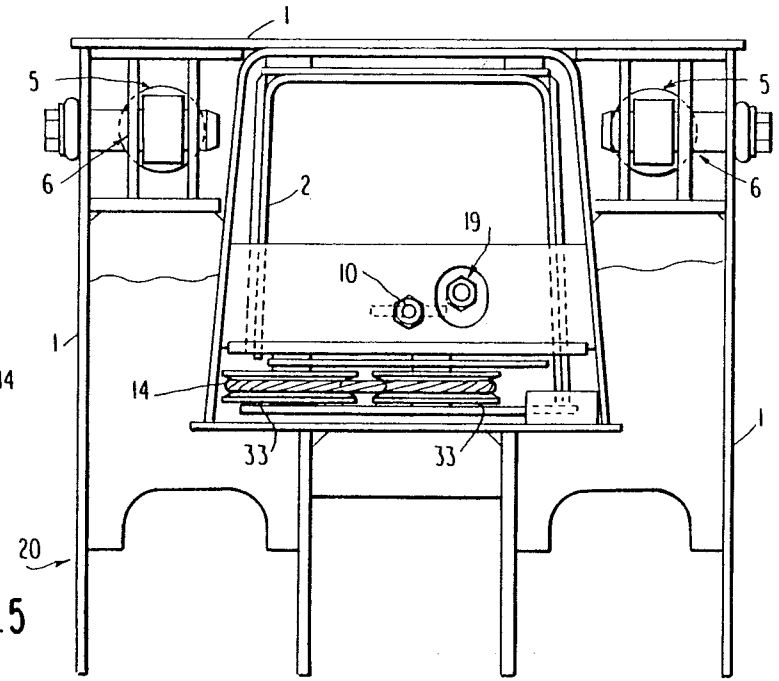
FIG. 5 is an end view, with parts omitted for clarity, taken along line 5—5 of FIG. 2.
Figure 6:
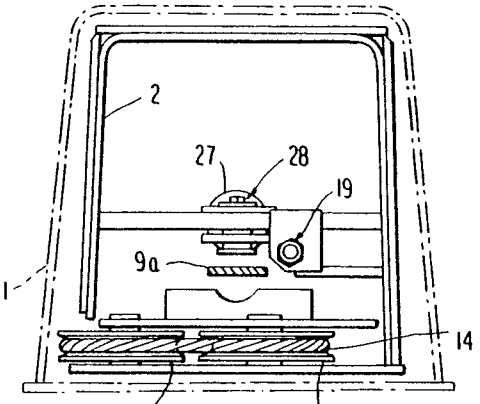
FIG. 6 is an end view of the inner mid section as viewed along line 6—6 of FIG. 4.

Referring to the drawings and more particularly to FIG. 1, the four section telescopic boom of the present invention comprises a base section 1, an inner mid section 2 slidably mounted within the base section 1, an outer mid section 3 slidably mounted within the inner mid section 2, and a fly section 4 slidably mounted in the outer mid section 3. As will be seen in FIGS. 1 and 5, a pair of hydraulic cylinder assemblies 5 are mounted exteriorly of the base section 1 on each side thereof, the proximate end of the cylinder 5*a* being connected to the proximate end of the base section as at 6, and the distal end of the cylinder being secured to the distal end of the base section as at 7, whereby the hydraulic cylinder 5*a* extends substantially the length of the base section 1. The distal end of the piston rod 5*b* is connected to the distal end of the inner mid section 2 as at 8. A first extension chain or cable 9, i.e. two chains side by side, is operatively connected between the proximate end of the base section as at 10 and the proximate end of the outer mid section 3, to be described more fully hereinafter. A second extension chain or cable 11 is operatively connected between the proximate end of the fly section 4 as at 12 and the distal end portion of the inner mid section 3 as at 13. By this construction and arrangement, when the hydraulic cylinder assemblies 5 are actuated to extend the inner mid section 2 outwardly of the base section 1, chain 9 simultaneously moves the outer mid section 3 outwardly of the inner mid section 2, and the chain or cable 11 causes the fly section 4 to move outwardly from the outer mid section 3.

In order to retract the extended boom sections, a first retract cable 14 is operatively connected between the distal end of the base section 1 as at 15, and the proximate end portion of the outer mid section 3 as at 16. A second retract cable 17 is operatively connected between the distal end portion of the fly section 4, as at 18, and the proximate end portion of the inner mid section 2, as at 19. By this construction and arrangement, when the hydraulic cylinder assemblies 5 are actuated to retract the boom sections, the inner mid section 2 is retracted within the base section 1, while cable 14 simultaneously pulls the outer mid section 3 into the inner mid section 2, and the cable 17 pulls the fly section 4 into the outer mid section 3.

To complete the general structural arrangement of the four section boom illustrated in FIG. 1, the proximate end of the base section 1 is provided with the conventional mounting assembly 20 including a journal connection 21 for pivotally connecting the boom assembly to a vehicle support, such as flat bed or turntable 21', and a connection 22 for a lift cylinder 22' so that the boom can be luffed about the pivot connection 21. A depending hanger assembly 23 is also connected to the base section 1 upon which a cable 23' can be mounted as at 24. The distal end of the fly section 1 is provided with a depending housing 25 in which suitable winch cable pull-ups or sheaves can be mounted.

Figures 2, 3:
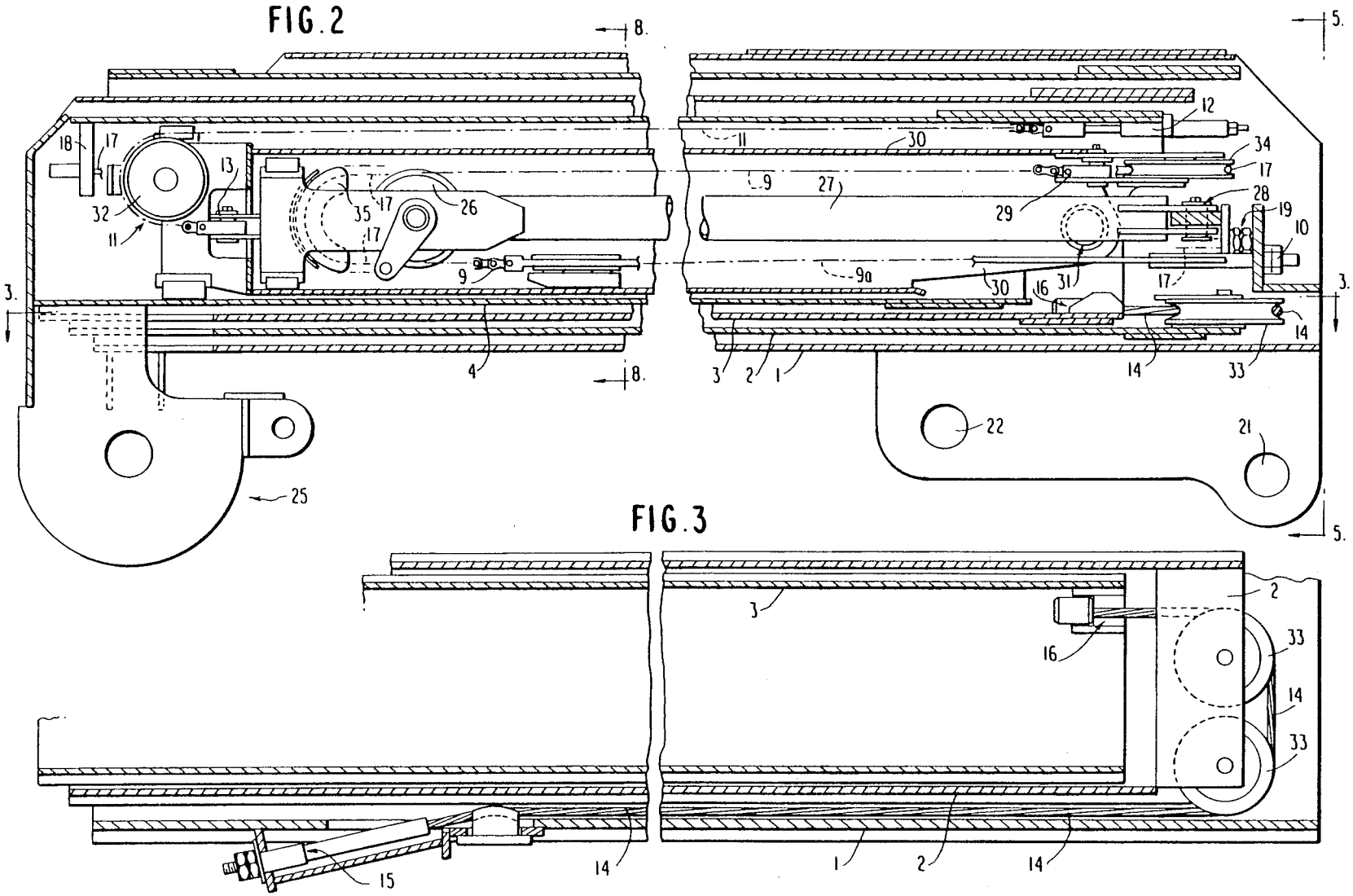
FIG. 2 is a sectional side elevational view showing the four section boom of the present invention in the fully retracted position.
FIG. 3 is a partial longitudinal sectional view taken along line 3—3 of FIG. 2.
Figure 4:
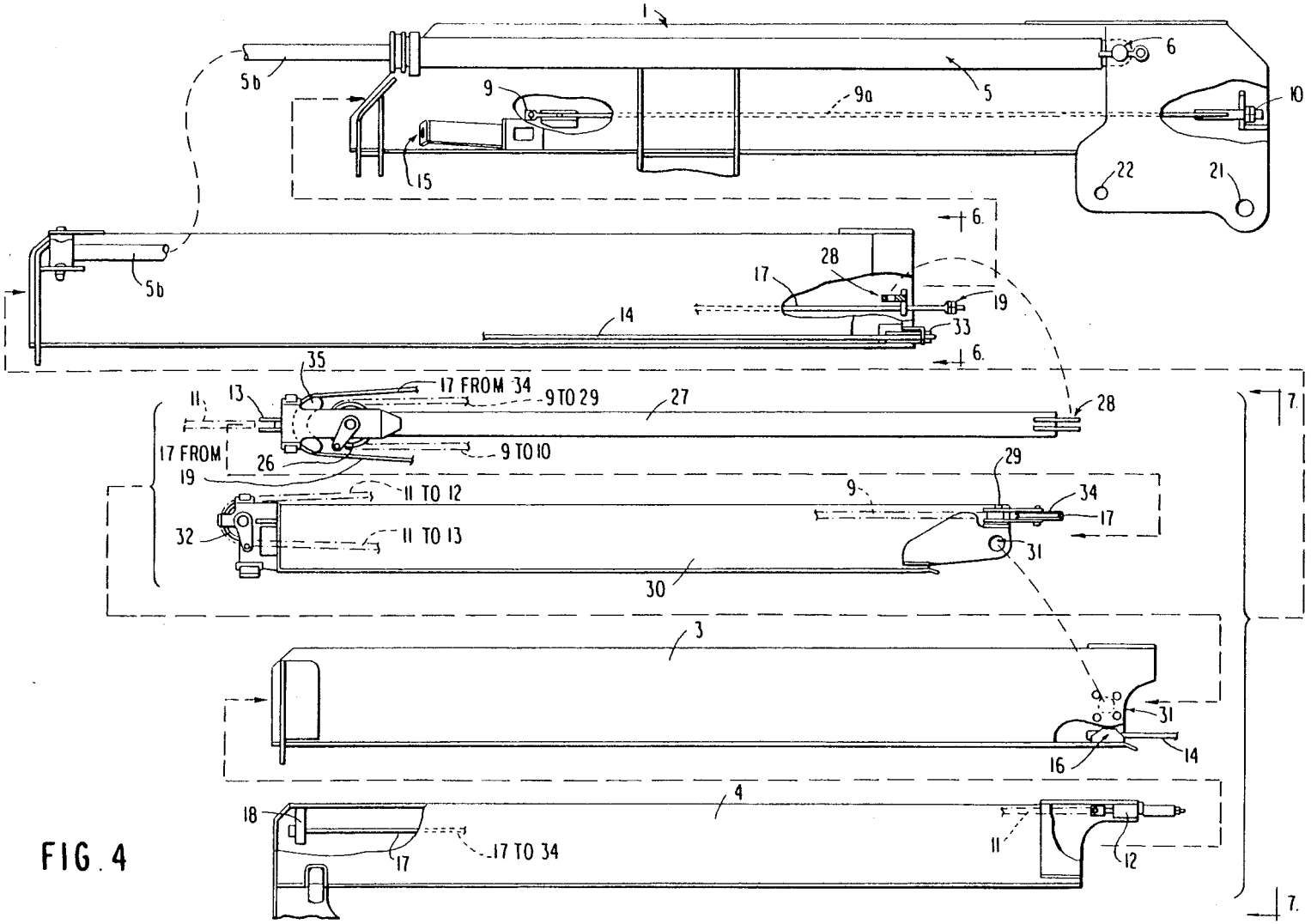
FIG. 4 is an exploded side elevational view of the four section boom assembly illustrating the interconnection of the various components of the assembly.

FIGS. 2, 3, and 4 illustrate the details of the construction of the components for locating the extension chains or elements 9 and 11, and the retraction chains or cables or elements 14 and 17 within the boom sections. The extension chain 9 includes a plate portion 9*a* which is fixedly connected to the proximate end of the base section at 10. The chain 9 extends around a pulley 26 rotatably mounted on the distal end of a tubular member 27 having its proximate end secured to the proximate end of the inner mid section 2 as at 28. The end of the chain 9 is connected as at 29 to the proximate end of a core frame member 30 journalled as at 31 to the proximate end of the outer mid section 3. It will thus be seen that tubular member 27 is positioned within the core frame member 30, which, in turn, is located within the outer mid section 3.

The other extension chain 11 has one end connected to the distal end portion of the tubular member 27 as at 13, and then reeved around a pulley 32 mounted on the distal end of the core frame member 30, the other end of the chain 11 being connected to the proximate end of the fly section as at 12.

Retraction cable or element 14 is attached to the distal end of the base section 1 as at 15 and extends rearwardly to the proximate end of the inner mid section 2 having a pair of transversely spaced pulleys 33 mounted thereon in a horizontal plane. The retraction cable 14 extends around the pulleys 33 and is attached to the proximate end of the outer mid section 3 as at 16, on the opposite side from the connection 15 to the base section.

The other retraction cable or element 17 has one end connected to the distal end of the fly section 4 as at 18; the cable 17 extends rearwardly and is reeved over a pulley 34 mounted horizontally on the proximate end of the core frame member 30. Cable 17 then extends forwardly therefrom around a vertically oriented arcuate saddle 35 secured to the distal end of the tubular member 27, and on one side thereof, and then extends back again to the proximate end of the inner mid section and secured thereto as at 19. Retracting cable or flexible retraction element 17 is thus reversed in longitudinal direction twice, and also reoriented approximately 90°, i.e. from a horizontal plane to a vertical plane, along its path between connections 18 and 19.

In the operation of the four section boom of the present invention to extend the boom section, as the hydraulic cylinder assemblies 5 extends the inner mid section 2 outwardly, the tubular member 27, being connected to the inner mid section 2 at 28, also moves with the inner mid section causing the extension chain 9 to move the core frame 30 together with the outer mid section 3 outwardly of the inner mid section 2. As the outer mid section 3 moves outwardly, the extension chain 11 extends the fly section 4.

To retract the boom section from the extended position, the hydraulic cylinder assemblies 5 retract the inner mid section 2 into the base section 1. As the mid section 2 moves back, so do pulleys 33 upon which the retraction cable 14 is reeved, which results in the outer mid section 3 also being pulled to the retracted position, since the retraction cable 14 is attached to the proximate end of the outer mid section 3 at 16.

Figure 9:
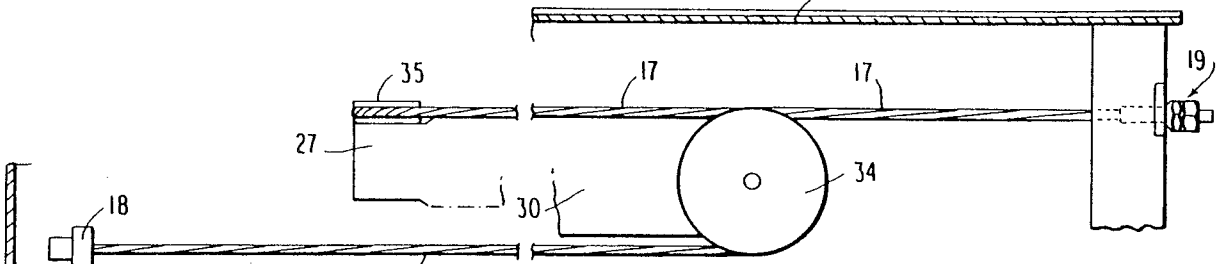
FIG. 9 is a fragmentary top plan view of a retraction cable operatively connected between the fly boom section and the inner mid section of the boom.
Figure 7:
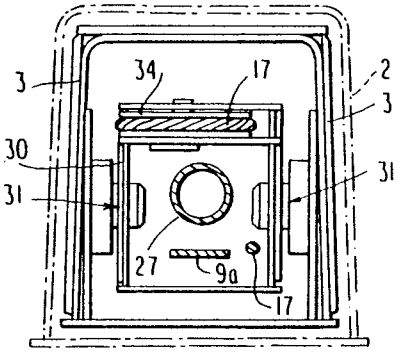
FIG. 7 is an end view of the assembled components as viewed along line 7—7 of FIG. 4.
Figure 8:
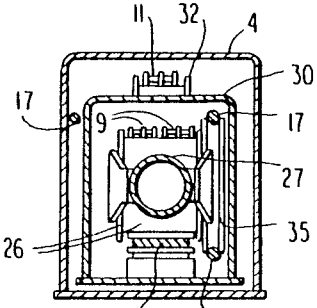
FIG. 8 is a partial cross-sectional view taken along line 8—8 of FIG. 2.
Figure 10:
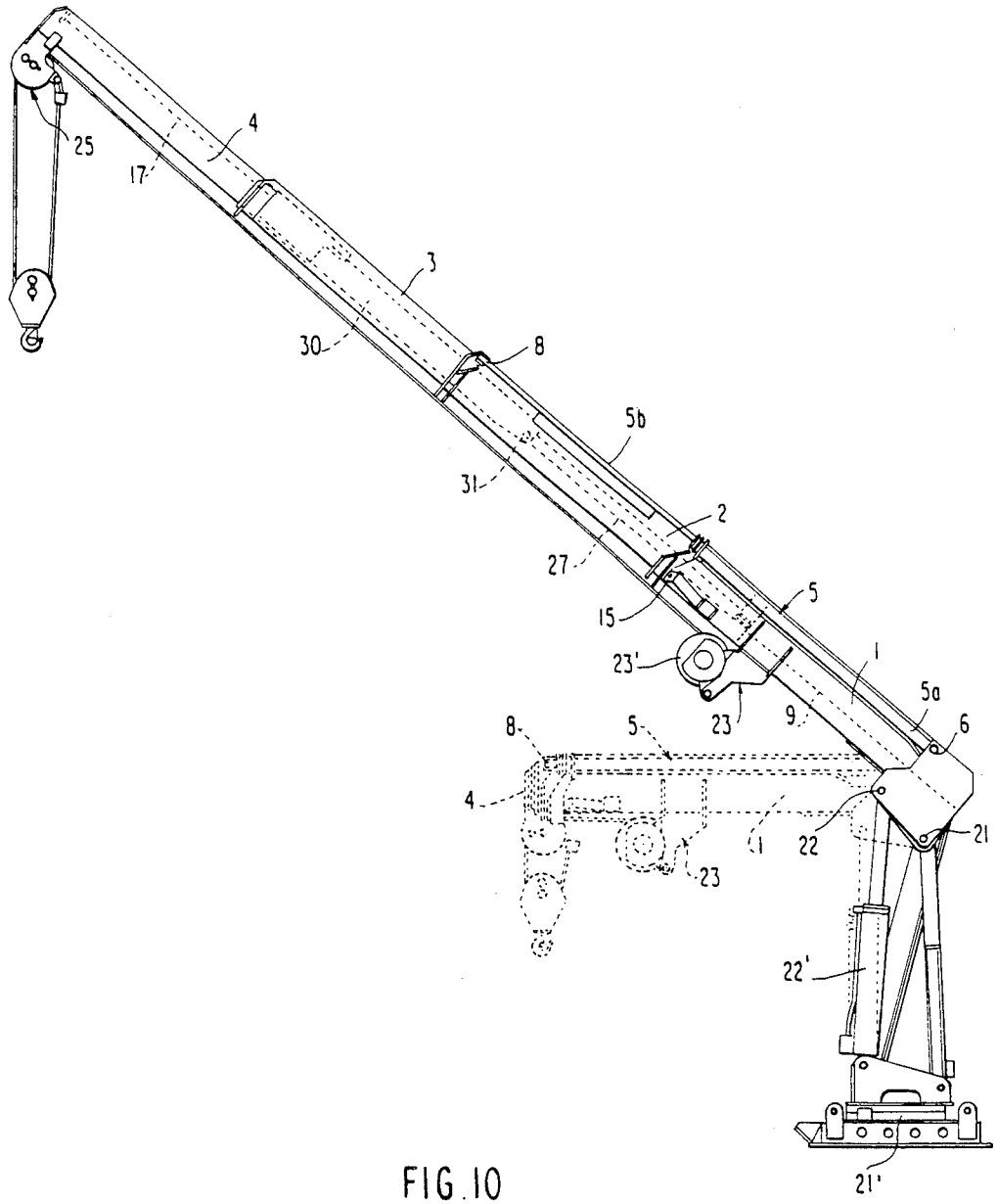
FIG. 10 is a side elevation view showing the four section boom of the invention mounted on a base member, in a fully extended elevated position in full lines, and in the lowered retracted position in dotted lines.

Since core frame member 30 (FIGS. 4, 7, and 9), carrying the pulley 34 upon which the retraction cable 17 is reeved, is positioned within and connected to the outer mid section 3; and since the tubular frame 27, carrying the saddle 35 around which the retraction cable 17 extends, is connected to the inner mid section 2; as inner mid section 2 and outer mid section 3 are pulled to the retracted position, the cable 17 being connected to the fly section 4 at 18 will pull the fly section 4 to the retracted position within the outer mid section 3.

It will be appreciated by those skilled in the art that by mounting the hydraulic cylinder assemblies 5 exteriorly of the telescopic boom, space is provided interiorly of the boom sections to accommodate the pair of exterior chains and cables 9 and 11, as well as the pair of retraction cables 14 and 17, whereby the chains and cables are protected from damage and from the elements, and by the construction and arrangement of the hydraulic cylinder assemblies and the extension chains and cables, actuation of the hydraulic cylinder assemblies results in the simultaneous and equal extension and retraction of the telescopic sections 2, 3, and 4.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. An extension and retraction system for a four section telescopic boom comprising, a base section, an inner mid section slidably mounted in said base section, an outer mid section slidably mounted in said inner mid section, and a fly section slidably mounted in said outer mid section, hydraulic cylinder means connected between the base section and said inner mid section, a first flexible extension element operatively connected interior of said sections between the base section and the outer mid section, and a second flexible extension element operatively connected interior of said sections between the fly section and the inner mid section, whereby, when the hydraulic cylinder means is actuated to extend the inner mid section outwardly of the base section, said first flexible extension element simultaneously moves the outer mid section outwardly of the inner mid section, and the second flexible extension element causes the fly section to move outwardly from the outer mid section; a first flexible retraction element operatively connected interior of said boom sections between the base section and the outer mid section, and a second flexible retraction element operably connected interior of said boom sections between the fly section, and the inner mid section, whereby when the hydraulic cylinder means is actuated to retract the boom sections, the inner mid section is retracted within the base section, while the first flexible retraction element simultaneously pulls the outer mid section into the inner mid section, and the second flexible retraction element pulls the fly section into the outer mid section.

2. An extension and retraction system according to claim 1, wherein the hydraulic cylinder means is positioned exteriorly of the boom sections.

3. An extension and retraction system according to claim 1, wherein the base section has a distal end, a length, a proximate end and opposite sides, said inner mid section having a distal end, said hydraulic cylinder means comprises a pair of hydraulic cylinder assemblies mounted exteriorly on said respective opposite sides of the base section, the cylinders having proximate ends connected to the proximate end of the base section, and said cylinders having distal ends being secured to the distal end of the base section, whereby, the hydraulic cylinders extend substantially the length of the base section, said hydraulic cylinders including piston rods having distal ends connected to the distal end of the inner mid section.

4. An extension and retraction system according to claim 1, wherein the base section has a proximate end, said outer mid section has a proximate end, said fly section has a proximate end, said inner mid section has a distal end portion, the first flexible extension element has one end connected to the proximate end of the base section, and the first flexible extension element having an opposite end operatively connected to the proximate end of the outer mid section, the second flexible extension element having one end connected to the proximate end of the fly section, and the second flexible extension element having an opposite end operatively connected to the distal end portion of the inner mid section.

5. An extension and retraction system according to claim 1, wherein the base section has a distal end, the outer mid section has a proximate end portion, said fly section has a distal end portion, said inner mid section has a proximate end portion, the first flexible retraction element has one end connected to the distal end of the base section, and the first flexible retraction element has an opposite end operatively connected to the proximate end portion of the outer mid section, the second flexible retraction element has one end connected to the distal end portion of the fly section, and the second flexible retraction element has an opposite end operably connected to the proximate end portion of the inner mid section.

6. An extension and retraction system according to claim 1, wherein a core frame member is positioned within the outer mid section, said core frame member having a proximate end portion and a distal end portion, said outer mid section having a proximate end portion, the proximate end portion of said core frame member being connected to the proximate end portion of the outer mid section, a first pulley assembly mounted on the distal end portion of said core frame member, and a second pulley assembly mounted on the proximate end portion of the core frame member, a tubular member having a proximate end portion and a distal end portion positioned within the core frame member and extending axially therein, a saddle and pulley assembly mounted on the distal end portion of the tubular member, said inner mid section having a proximate end portion, the proximate end portion of said tubular member being connected to the proximate end portion of the inner mid section, and a pulley assembly mounted on the proximate end portion of the inner mid section.

7. An extension and retraction system according to claim 6, wherein the base section has a proximate end, the first flexible extension element has one end connected to the proximate end of the base section, said first extension element extending from the proximate end of the base section to the pulley assembly on the distal end of the tubular member and from said pulley assembly to the proximate end of said core frame member, said first extension element has an opposite end connected to the proximate end portion of the core frame member, said fly section has a proximate end, the second extension element having one end connected to the proximate end of the fly section, said second extension element extending from the proximate end of the fly section to the first pulley assembly on the distal end of the core frame member, said second extension element extending from said first pulley assembly to the distal end of said tubular member, said second extension element has an opposite end connected to the distal end portion of the tubular member.

8. An extension and retraction system according to claim 6, wherein said base section has a distal end, the first retraction element has one end connected to the distal end of the base section, said first retraction element extending from said distal end of the base section to the pulley assembly in the proximate end of the inner mid section and from said pulley assembly to the proximate end of the outer mid section, said first retraction element having an opposite end connected to the proximate end of the outer mid section; said fly section has a distal end, the second retraction element having one end connected to the distal end of the fly section, said second retraction element extending from said distal end of the fly section to the second pulley assembly mounted on the proximate end portion of said core frame member, said second retraction element extending from said second pulley assembly to said saddle on the distal end of the tubular member, said second retraction element extending from said saddle to the proximate end of the inner mid section, said second retraction element having an opposite end connected to the proximate end portion of the inner mid section.

9. An extension and retraction system according to claim 5, including pulley means connected on the proximate end of said inner mid section, and said first flexible retraction element is reeved on said pulley means intermediate the end connection thereof.

10. An extension and retraction system according to claim 9, in which said pulley means comprise a pair of pulleys mounted transverse of the end of said inner mid section in substantially horizontal side by side relation.

11. An extension and retraction system according to claim 10, in which the connection of the opposite end of said first flexible retraction element to said outer mid section is on the opposite side of the boom from the connection of said one end thereof to said base section.

12. An extension and retraction system according to claim 5, wherein said inner mid section has a distal end, including pulley means operatively connected to the proximate end of said outer mid section and arcuate guide means operatively connected to the distal end of said inner mid section, and said second flexible retraction element extending from the connection of one end thereof to said fly section around said pulley means and thereafter around said arcuate guide means and thence to the connection of the opposite end thereof to the proximate end portion of said inner mid section.

13. An extension and retraction system according to claim 12, in which said arcuate guide means is disposed in a plane that is substantially normal to a plane in which is disposed said pulley means operatively connected to the proximate end of said outer mid section, whereby said second retraction element is reoriented substantially ninety degrees between its connections to said fly section and to said inner mid section.

14. An extension and retraction system according to claim 13, in which the portion of said second retraction element extending from said arcuate guide means to the proximate end portion of said inner mid section, is offset transversely and vertically from the portion of said second retraction element extending from the distal end portion of the fly section to said pulley means operatively connected to the proximate end of said outer mid section.

15. An extension and retraction system according to claim 1, in which said first and second extension elements comprise chain means; and said first and second retraction elements comprise cable means.

* * * * *